United States Patent [19]

Schulte et al.

[11] Patent Number: 5,007,213

[45] Date of Patent: Apr. 16, 1991

[54] LOCK SYSTEM FOR PASSING OBJECTS FROM A RADIOACTIVELY CONTAMINATED CHAMBER INTO A CONTAINER

[75] Inventors: Burkart Schulte, Minden; Hakan Sterner, Hanover; Gerhard Wetzka, Veitshöchheim; Norbert Hardt, Hanover, all of Fed. Rep. of Germany

[73] Assignee: Deutsche Gesellschaft für Wiederaufarbeitung von Kernbrennstoffen mbH, Hanover, Fed. Rep. of Germany

[21] Appl. No.: 408,545

[22] Filed: Sep. 18, 1989

[30] Foreign Application Priority Data

Sep. 19, 1988 [DE] Fed. Rep. of Germany ..... 3831775

[51] Int. Cl.[5] ..... E06B 5/00

[52] U.S. Cl. ..... 52/29; 52/204; 49/171; 49/39

[58] Field of Search ..... 52/20, 192, 196, 208, 52/204, 29, 36; 49/171, 39, 38

[56] References Cited

U.S. PATENT DOCUMENTS 3,593,467 7/1971 Francis ..... 52/29

3,911,900 10/1975 Shoen et al. ..... 52/29

*Primary Examiner*—Richard E. Chilcot, Jr.

*Assistant Examiner*—Joanne C. Downs

*Attorney, Agent, or Firm*—Walter Ottesen

[57] ABSTRACT

The invention is directed to a lock system for permitting objects to be passed from a contaminated chamber into a container which is disposed in a contamination-free chamber and docked to the lock system. The lock system of the invention includes a displaceable insert mounted on a partition wall separating the chambers. The insert is in the form of a round disc rotatable about its center point. The disc includes lock openings having different cross sections which are arranged on a circle concentric to the center of the disc. The lock system of the invention permits objects of different shape and size to be passed through the lock along only one removal path.

6 Claims, 1 Drawing Sheet

Fig. 2

LOCK SYSTEM FOR PASSING OBJECTS FROM A RADIOACTIVELY CONTAMINATED CHAMBER INTO A CONTAINER

FIELD OF THE INVENTION

The invention relates to a lock system for passing objects from a radioactivity contaminated chamber into a container located in a chamber free of contamination with the container being docked to the lock system.

SUMMARY OF THE INVENTION

It is an object of the invention to provide a lock system equipped with a cost-effective insert which permits passing objects of various shapes and/or sizes.

The lock system of the invention for passing objects from a contaminated first chamber through the lock system and into a container disposed in a contamination-free second chamber wherein the container can be docked at the lock system, the two chambers being separated by a partition wall. The lock system includes: opening means formed in the partition wall; a disc mounting a center point and being rotatably mounted in the opening means for rotation about an axis passing through the center point; and, a plurality of lock openings formed in the disc and arranged therein along an imaginary circle concentric to the center point.

With the docking system according to the invention, objects of different shapes and/or sizes can be passed out of the radioactively contaminated chamber along only one removal path. The lock system according to the invention also affords the advantage that no sealing difficulties are presented.

BRIEF DESCRIPTION OF THE DRAWINGS

The invention will now be described with reference to the drawings wherein.

DESCRIPTION OF THE PREFERRED EMBODIMENTS OF THE INVENTION

Figure 2:
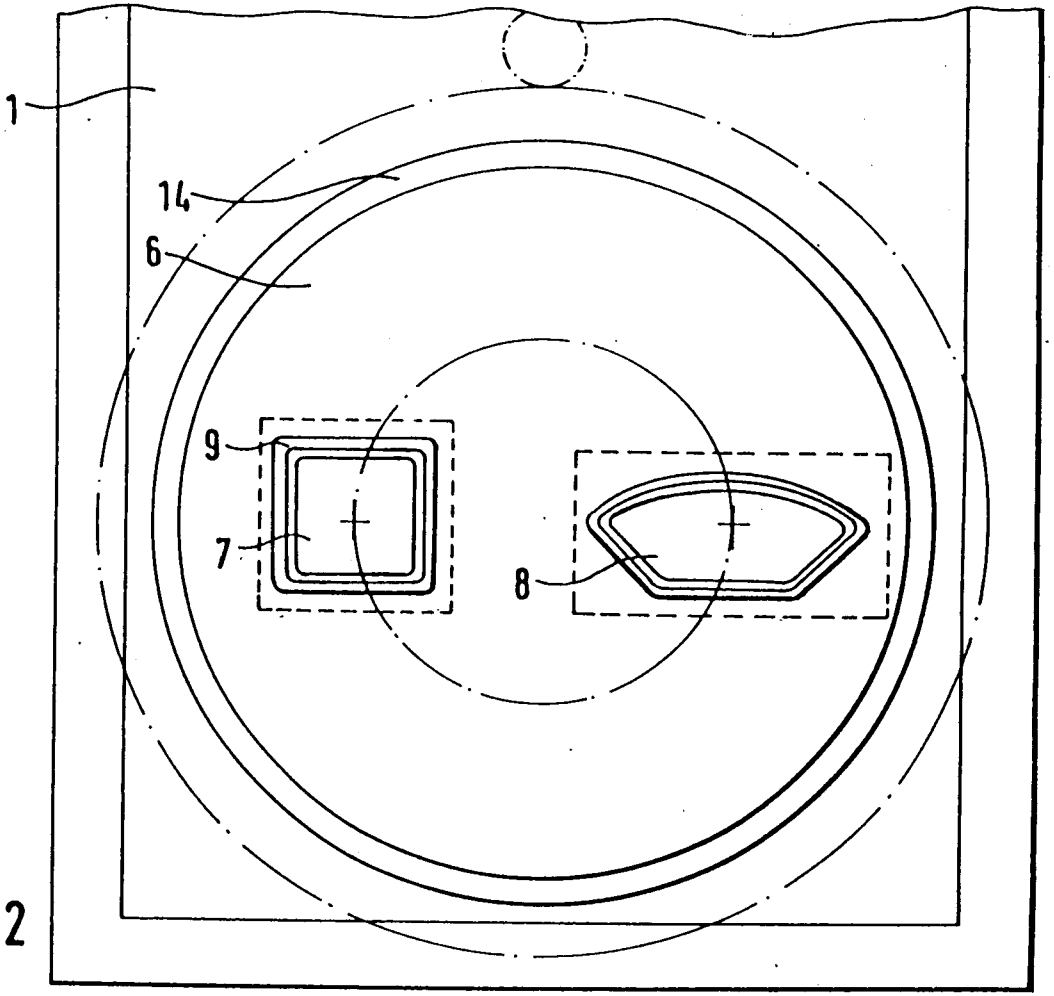
Figure 1:
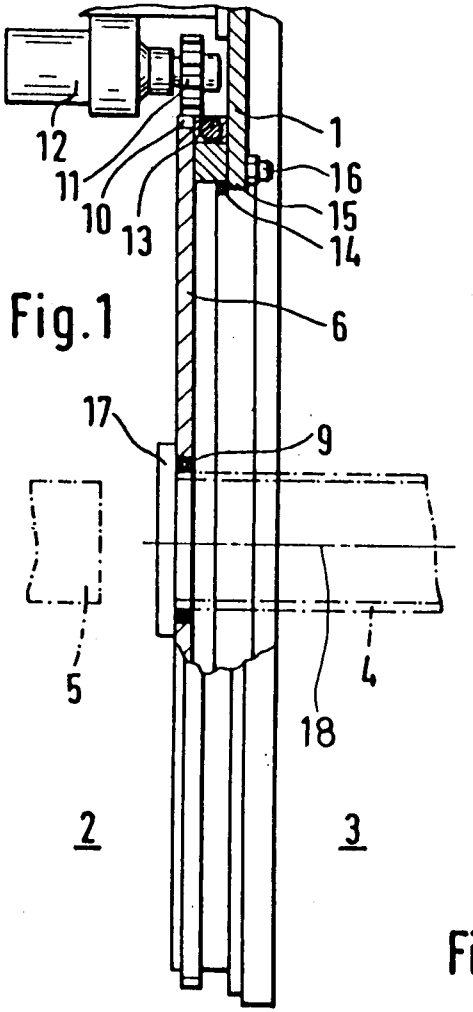
FIG. 1 is a side elevation view, partially in section, showing the lock system according to the invention; and, FIG. 2 is a schematic representation of the lock system of FIG. 1 viewed in elevation from the non-contaminated chamber.

Reference numeral 1 identifies a vertical ventilation partition wall which partitions a work area into two separate chambers 2 and 3 which are separately ventilated. The chamber 2 is exposed to open radioactivity and is contaminated since disassembled irradiated fuel elements are disposed therein and which are, for example, in the form of fuel rod bundles or pressed fuel element structural parts or so-called compacted packets and which are to be removed by passing the same through the lock system according to the invention. The chamber 3 is free of contamination and serves as an area for loading containers 4 with the radioactive objects 5 removed from chamber 2. The containers 4 serve to terminally store the radioactive objects.

The partition wall 1 includes an opening in front of which an insert 6 is disposed which has two lock openings 7 and 8 having respectively different cross sections. The opening 7 has a quadratic cross section and packets are passed through this opening. The opening 8 has a cross section in the form of a trapezoid, one base of which has an arcuate configuration. The opening 8 permits the pass through of fuel rod bundles. The lock openings 7 and 8 are configured to have a cross section which corresponds precisely to the dimensions of the terminal storage containers 4.

The lock openings 7 and 8 are widened to a region which accommodates an inflatable sealing ring 9. The insert 6 comprises a round disc having a center and the lock openings 7 and 8 are arranged on a circle concentric to the center of the disc. A toothed rim 10 is mounted on the periphery of the insert 6 and meshes with a pinion 11 which is rotatably driven by a drive 12 mounted on the partition wall 1. The insert 6 is attached to the partition wall via a turn-table holder 13 which permits rotation of the insert 6 about a longitudinal axis 18 passing through the center thereof. The turn-table holder 13 is sealed in the direction of chamber 3 by means of a sealing ring 14. The sealing ring 14 is exchangeable via remote manipulation and is attached to the partition wall 1 by means of threaded fasteners 16 with the aid of a shoulder 15. The lock openings 7 and 8 are closed when not in use by respective pivotally mounted covers 17 which close off the openings in a seal-tight manner.

The lock opening to be used is brought into position by means of the rotatable insert 6 and the cover of this opening is then removed by remote manipulation. Thereafter, the closure of the container 4 is removed after the container has been docked to the insert 6 via the seal 9.

It is understood that the foregoing description is that of the preferred embodiments of the invention and that various changes and modifications may be made thereto without departing from the spirit and scope of the invention as defined in the appended claims.

What is claimed is:

1. A lock system for passing objects from a contaminated first chamber through the lock system and into a container disposed in a contamination-free second chamber wherein the container can be docked at the lock system, the two chambers being separated by a partition wall, the lock system comprising:

opening means formed in said partition wall;

a disc defining a center point and being rotatably mounted in said opening means for rotation about an axis passing through said center point; and, a plurality of lock openings formed in said disc and arranged therein along an imaginary circle concentric to said center point.

2. The locking system of claim 1, a first one of said lock openings having a periphery defining a quadrilateral; a second one of said lock openings having a periphery defining a trapezoid having two bases; and, one of said bases having an arcuate configuration.

3. The lock system of claim 1, wherein the container is intended for use with a selected one of said lock openings; and, said one opening having a periphery corresponding to the dimensions of the container.

4. The lock system of claim 1, wherein each of said openings defines a periphery for accommodating a container, said system further comprising inflatable sealing means disposed at the peripheries of said openings; and, said opening being expanded to accommodate said sealing means.

5. The lock system of claim 1, said system further comprising: a turn-table holder for holding said disc on said partition wall.

6. The lock system of claim 5, said system further comprising: an annular sealing ring interposed between said turn-table holder and the partition wall; an annular shoulder for holding said sealing ring; and, fastener means for holding said shoulder and said sealing ring in place on the partition wall.

* * * * *